United States Patent [19]

Takeda et al.

[11] 4,421,838

[45] Dec. 20, 1983

[54] PROCESSES FOR PREPARING PHOTOCONDUCTIVE ELEMENTS AND ELECTROPHOTOSENSITIVE MATERIALS

[75] Inventors: Keiji Takeda; Mitsuharu Nirasawa; Masayoshi Nagata, all of Asaka, Japan

[73] Assignee: Fuji Photo Film Co., Ltd., Kanagawa, Japan

[21] Appl. No.: 255,391

[22] Filed: Apr. 20, 1981

Related U.S. Application Data

[63] Continuation of Ser. No. 102,806, Dec. 12, 1979, abandoned.

[30] Foreign Application Priority Data

Dec. 13, 1978 [JP] Japan ..... 53-155267
Jul. 5, 1979 [JP] Japan ..... 54-85396

[51] Int. Cl.[3] ..... G03G 5/08

[52] U.S. Cl. ..... 430/58; 430/84; 430/127; 430/130

[58] Field of Search ..... 430/127, 130, 135, 66, 430/84, 58

[56] References Cited

U.S. PATENT DOCUMENTS

| | | | |
|---|---|---|---|
| 2,663,636 | 12/1953 | Middleton | 430/135 |
| 4,007,100 | 2/1977 | Chu et al. | 430/130 |
| 4,115,115 | 9/1978 | Marsh | 430/130 |

*Primary Examiner*—John E. Kittle
*Assistant Examiner*—John L. Goodrow
*Attorney, Agent, or Firm*—Sughrue, Mion, Zinn, Macpeak and Seas

[57] ABSTRACT

A photoconductive element comprising elemental selenium dispersed in an insulating polymer is prepared by reducing an inorganic selenium compound in the presence of the insulating polymer. The invention also provide a process for preparing an electrophotosensitive material having a photoconductive layer in which reduction of the inorganic selenium compound is performed in a layer coated on a conductive support.

48 Claims, No Drawings

PROCESSES FOR PREPARING PHOTOCONDUCTIVE ELEMENTS AND ELECTROPHOTOSENSITIVE MATERIALS

This is a continuation of application Ser. No. 102,806, filed Dec. 12, 1978, now abandoned.

BACKGROUND OF THE INVENTION

1. Field of the Invention

This invention relates to a process for preparing photoconductive elements and also to a process of preparing electrophotosensitive materials from such photoconductive elements.

2. Description of Prior Art

As is well known, in electrophotographic processes electrostatic charges are uniformly applied to a layer of a photoconductive substance, the photoconductive layer is imagewise exposed to thereby discharge the electrostatic charges in the exposed areas, and the images of the remaining electrostatic charges (electrostatic latent images) are developed with colored particles (toner) having charges of the opposite polarity to form visible images. As photoconductive substances used for electrophotosensitive materials, there are known inorganic substances such as amorphous selenium, a compound semiconductor, etc.; organic polymers such as polyvinylcarbazole, etc.; and compositions composed of various organic compounds and organic dyes or pigments as sensitizers. Among these materials, amorphous selenium is most frequently used.

Electrophotosensitive materials based on amorphous selenium are usually prepared by vapor depositing selenium on a conductive support. However, with this technique, the continuous production of the electrophotosensitive materials is difficult and production costs are high. Also, vapor deposited amorphous selenium layers are only sensitive to light of wavelengths shorter than 520 mm and have such demerits that they are liable to crystallize during use (for example if scratched) and thus their characteristics as photosensitive materials tend to deteriorate.

To overcome these drawbacks it has been proposed to disperse selenium particles and particularly trigonal selenium particles in a layer formed on a conductive support. Trigonal selenium is sensitive to substantially all visible light, however, due to its low dark electric resistance it cannot hold a sufficient charge unless it is dispersed in an insulating binder. U.K. Pat. No. 1,506,929 describes photoconductors prepared by mechanically pulverizing the crystalline (trigonal) selenium and dispersing the pulverized crystals in a polymer (PVK) having a charge carrier transporting ability. U.S. Pat. No. 3,787,208 also describes photoconductors prepared by mechanically pulverizing solid amorphous selenium in liquid nitrogen and dispersing it in a polymer. In the course of the preparation the layer of dispersed selenium is heated to 230° C. which may convert the selenium to the trigonal form although this is not clear from the disclosure. It is still difficult even using these techniques to prepare photoconductive layers having fine selenium particles formed by mechanical pulverization uniformly dispersed therein.

On the other hand, a method of preparing layer of a dispersion of fine selenium particles utilizing light irradiation is described in U.S. Pat. No. 3,994,791. A layer comprising elemental selenium dispersed in a polymer is prepared by forming on a conductive support a layer of an organic selenium compound dispersed in an insulating polymer (e.g., poly-N-vinylcarbazole) and uniformly exposing the layer to light to decompose the organic selenium compound. However, in this method the organic selenium compounds used are generally unstable and expensive and the compounds, their decomposition products or by-products formed during their synthesis are for the most part toxic or bad smelling. Furthermore, when an organic selenium compound is photodecomposed in a polymer layer, the compound disposed nearer the surface of the layer is decomposed to a greater extent due to the nonuniform absorption of light. Consequently, it is difficult to produce photoconductive layers having elemental selenium uniformly dispersed therein by the aforementioned method. Also, the technique is undesirably restricted in that the polymers used in the method are limited to insulating polymers having charge carrier transporting characteristics.

U.S. Pat. No. 4,115,115 also describes a method for forming a layer of elemental selenium dispersed in a polymer by reacting an organic selenium compound and dibenzoyl peroxide in a polymer. This method, however, has the drawbacks of the aforementioned method attributed to the use of organic selenium compounds, and benzoyl peroxide has an explosive property so great care must be taken for its handling.

SUMMARY OF THE INVENTION

An object of this invention, is, therefore, to provide a process for preparing a photoconductive element comprising particles of elemental selenium dispersed in a polymer by a chemical reduction without vapor deposition and photodecomposition and also without the various drawbacks encountered in the aforementioned methods using organic selenium compounds.

Another object of this invention is to provide a process of preparing electrophotosensitive materials having high light sensitivity using the photoconductive element obtained in the above process in which the amount of selenium used is less than in the case of elements prepared from vapor deposited amorphous selenium.

Still another object of the present invention is to provide a process for preparing a photoconductive element containing trigonal selenium particles dispersed in a binder polymer by chemical reduction.

Other objects of this invention will become apparent from the following description of the invention.

The above-mentioned objects of this invention can be attained by preparing a photoconductive element comprising elemental selenium finely dispersed in an insulating polymer fundamentally by chemically reducing an inorganic selenium compound in the presence of the insulating polymer.

That is, according to the process of this invention, a photoconductive element comprising fine selenium particles dispersed in an insulating binder polymer is obtained by chemically reducing an inorganic selenium compound contained in a liquid or solid phase in an insulating polymer, whereby elemental selenium is liberated in the phase. The selenium particles thus formed are capable of generating charge carriers upon irradiation with light and thus the photoconductive element thus obtained can be used in photoelectric conversion elements such as photoelectric cells, electrophotosensitive materials, etc.

According to an embodiment of this invention, a photoconductive element is prepared by dissolving or dispersing (a) an inorganic selenium compound and (b)

an insulating polymer in a solvent capable of dissolving at least the polymer (b), whereby finely deposited and dispersed elemental selenium is liberated upon a reduction reaction with functional groups or impurities in the solvent or insulating polymer.

According to a more preferred embodiment of this invention, however, the photoconductive element is prepared by dissolving or dispersing (a) an inorganic selenium compound, (b) an insulating binder and (c) a reducing agent in a solvent capable of dissolving at least the polymer (b), coating the solution or dispersion on a conductive support and heating the coated support such that elemental selenium is liberated and occurs uniformly dispersed in the polymer matrix as fine deposits. In accordance with still another embodiment of the present invention, the reducing agent is a hydrazide and trigonal selenium is produced in a uniformly dispersed state within the polymer matrix.

In another embodiment of this invention the layer of dispersed selenium is heated in contact with a charge transporting layer.

DESCRIPTION OF THE INVENTION

In this specification the following abbreviations have been adopted:

CTM: charge transfer material

CTL: charge transporting layer

CGL: charge generating layer

Any inorganic compound which can liberate elemental selenium upon reduction may be used as the inorganic selenium compound in the process of this invention. Among them, inorganic selenium compounds which are solid at room temperature, relatively stable, and soluble in solvents and particularly organic solvents are preferred. Inorganic selenium compounds having such properties include selenium dioxide, selenious acid, selenium (IV) oxybromide ($SeOBr_2$), selenium tetrachloride, and selenium tetrabromide. Among these compounds, selenium dioxide and selenious acid are more preferred because they do not smell bad, can be easily handled, and are particularly suitable for the practice of this invention.

The insulating polymers used in the process of this invention act as a protective colloid or binder for the finely dispersed elemental selenium liberated from the inorganic selenium compound upon reduction. As the insulating binder polymers, various synthetic, semi-synthetic and natural high molecular weight dielectric materials having a suitable film forming molecular weight (more than about 10,000 to about 1,000,000) are suitable and high molecular weight dielectric materials which do not notably decompose when heated for about 10 minutes at temperatures up to about 250° C. are particularly preferred.

The insulating polymers may or may not have charge carrier transporting ability. In general, polymers used as insulating binders in electrophotosensitive materials may be used in this invention. Practical examples of suitable binder polymers for use in this invention are polyvinyl chloride, vinyl chloride-vinyl acetate copolymer, vinylidene chloride-vinyl chloride copolymer, vinylidene chloride-acrylonitrile copolymer, polystyrene, poly-α-methylstyrene, polymethyl methacrylate, polymethyl acrylate, polybutyl acrylate, polyvinylbutyral, polyvinylformal, polyvinylpyrrolidone, polyvinyl alcohol, polyacrylamide, polyacrylonitrile, diacetyl cellulose, triacetyl cellulose, cellulose acetate phthalate, cellulose acetate butyrate, ethyl cellulose, cyanoethyl cellulose, poly-N-vinylcarbazole, polyvinylpyrene, polyester (e.g., polyethylene terephthalate, polycarbonate of bisphenol A, etc.), polyamide (e.g., nylon-6, nylon-6,6, nylon-6,10, etc.), styrene-butadiene copolymer, styrene-methyl methacrylate copolymer, vinylidene chloride-vinyl acetate copolymer, a phenol-formaldehyde resin, etc. In addition, in the case of the above copolymers, there is no particular limitation on the respective monomer contents. Particularly preferred electrically insulating binder polymers among the above-illustrated materials when using a hydrazide as the reducing agent are polyvinyl butyral, diacetyl cellulose, triacetyl cellulose, acrylonitrile-styrene-butadiene copolymer, cumaroneindene resin, and polymethyl methacrylate. When using other reducing agents, polymethyl methacrylate, acrylonitrile-styrene copolymer, acrylonitrile-butadiene-styrene and polycarbonate are particularly suitable since their charge carrier generating efficiency is high.

According to this invention, the deposition of elemental selenium occurs to some extent without the addition of a reducing agent and photoconductive elements possessing a considerable charge carrier generating efficiency may be obtained. This is considered to be based on the fact that although an inorganic selenium compound is stable as it is, the reduction of the inorganic selenium compound occurs by the co-action with the insulating binder polymer and/or the solvent, in particular, during drying under heat. Particularly, when the insulating polymer or the solvent itself possesses a reducing property or when they have no reducing property but some reducing material is formed during the production of the photoconductive elements, or the insulating polymer or solvent contains reducing materials as impurities, the reduction of the inorganic selenium compound proceeds. For example, ketone series solvents such as acetone frequently contain aldehyde derivatives capable of reducing inorganic selenium compounds.

However, to perform the deposition of selenium fully and efficiently, it is preferred to add reducing agents. Therefore, according to a preferred embodiment of this invention, a photoconductive element is prepared by dissolving or dispersing (a) an inorganic selenium compound, (b) an insulating polymer, and (c) a reducing agent in a solvent capable of dissolving at least the polymer (b), whereby selenium is liberated from the compound (a) by reduction and finely deposited and dispersed in the polymer (b). In this case, the inorganic selenium compounds, the insulating polymers, the solvents, and the production conditions, etc., are fundamentally the same as for the first embodiment described above.

The reducing agents used in accordance with this embodiment of the present invention may be materials which can liberate elemental selenium by reducing the inorganic selenium compounds and a wide variety of organic or inorganic reducing agents can be effectively used in this invention. Reducing agents may be used alone or as mixtures of two or more compounds in appropriate ratios. In general, the reducing power of reducing agents used in combination is not always a simple sum of the reducing powers of individual reducing agents but is frequently higher than the simple sum, which is known as "super-additivity". Therefore, compounds which individually do not have sufficient reducing power can be used in a mixed system. The reducing agents (they may be used alone or as mixtures of two or more compounds) useful in this invention can be easily selected by the following method.

Each of 10 mg of selenium dioxide and a test reducing agent or agents in an amount of 2 molar times that of selenium dioxide (when two or more kinds of reducing agents are tested as a mixture of time, the total molar of them is two molar times that of selenium dioxide) are separatedly dissolved in 1 ml of a solvent, which dissolves both the selenium dioxide and the reducing agent, selected from ethanol, N,N-dimethylformamide and tetrahydrofuran. After mixing the two solutions uniformly in a test tube followed by sealing the tube, the test tube is placed in a bath at temperatures of 100° C.±5° C. If orange to red coloring which accompanies the deposition of elemental selenium is noticed in the solution or on the surface of the vessel within 30 minutes, the reducing agent or mixture of reducing agents would be considered useful in this invention. This test method is only a screen for determining the lower limit of the ability of the reducing agent or agents. If the reducing power of the reducing agent tested is lower than the lower limit of the test, the deposition of elemental selenium is reduced and the light sensitivity of electrophotosensitive materials based on such a photoconductive element is lower than that of the case of using reducing agents higher than the lower limit. Accordingly, the lower limit shown in the test is not a strict limit. That is, electrophotosensitive materials prepared using such a reducing agent should not be regarded as inoperable but only as providing a relatively low light sensitivity. Therefore, the above-described lower limit is only a measure for electrophotosensitive materials having a desirably sufficient light sensitivity and depending on the object, the reducing agent may be used in this invention even if the reducing agent is out of the above-mentioned limit.

In general, the reducing agents which are suitable as developing agents for silver halide photographic materials can be used as the reducing agent in this invention. This is not to say that all silver halide developing agents are useful in the present invention, the above test is still determinative. Examples of such reducing compounds are described in, for example, C. E. K. Mees and T. H. James, *The Theory of the Photographic Process,* 3rd edition, 1966, Macmillan Company, Chapter 13. Examples of compounds used as reducing agents in this invention are aromatic hydrocarbons such as benzene, naphthalene, anthraquinone, etc., each substituted by at least one hydroxy group and/or amino group or a substituted amino group (e.g., hydroquinone derivatives, aminophenol derivatives, aniline derivatives, p-phenylenediamine derivatives, etc.); hydrazine derivatives; ascorbic acid derivatives; pyrazolone derivatives; pyrazolidone derivatives; urea derivatives; organic compounds such as oxalates, aldehydes, etc.; and salts of metals in a low valence state (e.g., salts of iron(II), tin(II), titanium(III), chromium(II), etc.).

Practical examples of the reducing agents which can be used in this invention are trimethylhydroquinone, tetramethylhydroquinone, 2,5-di-tert-butylhydroquinone, methoxyhydroquinone, (1,1-dimethyl-3,3-dimethylbutyl)hydroquinone, 2-(α,α-dimethylbenzyl)-5-tert-butylhydroquinone, 2-(α,α-dimethylbenzyl)-5-(1,1-dimethyl-3,3-dimethylbutyl)hydroquinone, 2,5-di(1,1-dimethylbutyl)hydroquinone, 2,5-dimethylhydroquinone, 1-N-benzylaminophenol, p-N-methylaminophenol, 2-phenylhydroquinone, N-ethyl-N-hydroxyethyl-2-methyl-p-phenylenediamine, N,N-dimethyl p-phenylenediamine, N,N,N',N'-tetramethyl-p-phenylenediamine, hydrazide derivatives as shown later, acetohydrazine, o-aminobenzoylhydrazine, acetylphenylhydrazine, salicyloylhydrazine, 1-methyl-1-phenylhydrazine, L-ascorbic acid, L-ascorbyl monopalmitate, L-ascorbyl monostearate, 3-pyrazolidone, 1-phenyl-3-pyrazolidone, 1-p-tolyl-4-hydroxymethyl-4-methyl-3-pyrazolidone, thiourea, dimethylolthiourea, tetramethylthiourea, thiouracil, 4-methoxy-1-naphthol, 4-ethoxy-1-naphthol, 4-aminodiphenylamine, N,N,N',N'-tetramethyl-p,p'-diaminodiphenylamine, iron(II) oxalate, tin(II) chloride, etc.

When the above screen test was conducted with the reducing agents shown in Table 1 below the following results were obtained.

TABLE 1

| Reducing Agent | Change at Room Temp. After Mixing | After 30 min. at 100° C. |
|---|---|---|
| L-Ascorbyl monopalmitate | red ppt formed immdely. | red - black ppt formed |
| Salicyloylhydrazide | red ppt formed immedly. | red - black ppt formed |
| 1-Phenyl-3-pyrazolidone | orange ppt. formed immedly. | red - black ppt formed |
| Thiourea | orange ppt formed after about 10 sec. | red - black ppt formed |
| Trimethylhydroquinone | no change within 30 sec. | red suspension in soln. and red to black matter on the wall |
| Tetramethylhydroquinone | no change within 30 sec. | red suspension in soln. and red to black matter on the wall |
| Methoxyhydroquinone | no change within 30 sec. | red suspension in soln. and red to black matter on the wall |
| 2,5-Di-tert-butylhydroquinone | no change within 30 sec. | red suspension in soln. and red to black matter on the wall |

Of the above reducing agents there are certain advantages to using hydrazide derivatives represented by the following formula (I) as described below:

$$R—CO—NH—NH_2 \quad (I)$$

wherein R represents a straight chain or branched alkyl group having 1 to 8 carbon atoms, a phenyl group, or a substituted phenyl group. As the substituent for the substituted phenyl group, there are a straight chain or branched alkyl groups having 1 to 5 carbon atoms, a hydroxy group, an alkoxy group having a straight chain or branched alkyl group of 1 to 5 carbon atoms, an amino group, an acetylamino group (—$NHCOCH_3$), and an alkylamino or dialkylamino group wherein the hydrogen atom or atoms of the amino group have been substituted by methyl group or ethyl group. In the substituted phenyl group, the substituent may be bonded to the —CO—NH—$NH_2$ group at any position, and contain 1 to 3 substituents. When there are 2 or 3 substituents they may be the same or different.

Among these hydrazides, those of the above-mentioned general formula (I) wherein R is a straight chain alkyl group of 1 to 5 carbon atoms and R is a hydroxyl group- or methyl group-substituted phenyl group are particularly preferred in the process of this invention.

Practical examples of the hydrazides are hydrazide acetate (acetylhydrazide), hydrazide propionate, hydrazide butyrate, hydrazide valerate ($C_5H_{11}CONHNH_2$), hydrazide benzoate, hydrazide salicylate, hydrazide p-hydroxybenzoate, hydrazide m-hydroxybenzoate, hydrazide 2,3-dihydroxybenzoate, hydrazide, 3,4-dihydroxybenzoate (protocatechuic acid), hydrazide 3,5-dihydroxybenzoate (α-resorcinic acid), hydrazide 2,4-dihydroxybenzoate, hydrazide 2,6-dihydroxybenzoate, hydrazide 2,5-dihydroxybenzoate (gentisic acid), hydrazide 3,4,5-trihydroxybenzoate (gallic acid), hydrazide 4-methylsalicylate, hydrazide 5-methylsalicylate, hydrazide 3-hydroxy-2-methylbenzoate, hydrazide 2-hydroxy-3,5-dimethylbenzoate, hydrazide 3-hydroxy-4-isopropylbenzoate, hydrazide 4,6-dihydroxy-2-methylbenzoate, hydrazide 2,6-dihydroxy-4-methylbenzoate, hydrazide o-methoxybenzoate, hydrazide p-methoxybenzoate, hydrazide o-methylbenzoate, hydrazide m-methylbenzoate, hydrazide p-methylbenzoate, hydrazide o-ethylbenzoate, hydrazide o-aminobenzoate, hydrazide m-aminobenzoate, hydrazide p-aminobenzoate, hydrazide 2,3-diaminobenzoate, hydrazide p-dimethylaminobenzoate, and hydrazide p-acetylaminobenzoate.

Practical examples of the particularly preferable hydrazides in the process of this invention are hydrazide acetate, hydrazide propionate, hydrazide salicylate, hydrazide p-hydroxybenzoate, hydrazide 2,4-dihydroxybenzoate, hydrazide 4-methylsalicylate, and hydrazide o-methylbenzoate.

In addition, the other reducing agents described above can be used together with the above-mentioned hydrazide as the reducing agents in the process of this invention.

The amount of the reducing agent used (the sum of the amounts of reducing agents when a mixture of them is used) depends on the reducing power thereof, etc., but is generally from about 0.1 to about 10 moles, preferably from about 1 to about 3 moles per mole of the inorganic selenium compound.

In the case of producing photoconductive elements using the reducing agent or agents, other factors, i.e., the inorganic selenium compounds, the insulating polymers, the solvents, and production conditions are fundamentally the same as those in the case of not intentionally using the reducing agent.

Hereafter the present invention will be described with respect to the reducing agent being present. It will be remembered however that in some cases trigonal selenium can be obtained without the reducing agent. The inorganic selenium compound, the reducing agent and the insulating polymer are dissolved or dispersed in a solvent capable of dissolving at least the insulating polymer. Thus, any solvents which can dissolve at least the binder polymer used may be used and the solvent used in this invention can be selected from any of various solvents. However, considering handling of the solution or dispersion for preparing photoconductive elements and the removal of the solvent, solvents having boiling points of from about 30° C. to about 200° C. are preferred. Examples of suitable solvents are alcohols such as methanol, ethanol, isopropanol, etc.; aliphatic ketones such as acetone, methyl ethyl ketone, cyclohexanone, etc.; amides such as N,N-dimethylformamide, N,N-dimethylacetamide, etc.; ethers such as dimethyl sulfoxide, tetrahydrofuran, dioxane, ethylene glycol monomethyl ether, etc.; esters such as methyl acetate, ethyl acetate, etc.; halogenated hydrocarbons such as chloroform, methylene chloride, ethylene dichloride, carbon tetrachloride, trichloroethylene, etc.; hydrocarbons such as benzene, toluene, xylene, ligroin, etc.; and water. These solvents may be used alone or as mixtures of two or more. Solvents which can dissolve the binder polymer the inorganic selenium compound and the reducing agent are particularly preferred. When polyvinylbutyral is used as the binder polymer, a lower aliphatic alcohol such as methanol, ethanol, isopropyl alcohol, etc., is preferably used as the solvent in this invention.

There is no particular restriction about the ratios of the components in the solution or dispersion for preparing the photoconductive element in this invention but, in general, it is preferred to use the inorganic selenium compound in an amount of from about $10^{-4}$ mole to about $10^{-2}$ mole, particularly $5\times10^{-4}$ to $5\times10^{-3}$ mole per gram of the insulating polymer and to use the insulating polymer in an amount of from about 0.005 g to about 0.5 g, preferably about 0.01 to 0.1 g per milliliter of the solvent. The amount of reducing agent has been defined above.

A solution or dispersion for photoconductive elements prepared by properly mixing the inorganic selenium compound, insulating polymer reducing agent and solvent may be made to a desired form according to the objects and uses thereof to provide photoconductive elements. For example, a layer-like photoconductive element can be formed by coating the solution or dispersion on a suitable support and removing (by drying) the solvent.

The coating composition may be prepared by dissolving simultaneously the above-mentioned three components or may be prepared by dissolving the three components successively. Or, the coating composition may be prepared by dissolving one or two components in each solvent and mixing the solutions thus prepared. However, it is preferred, especially when a strong reducing agent such as the hydrazide is used, to mix the inorganic selenium compound and the reducing agent in the presence of the electrically insulating polymer, that is, in a solution of the polymer. This is because frequently the inorganic selenium compound is immediately reduced due to the strong reductive power of the reducing agent and selenium deposited by the reduction aggregates in a liquid having a low viscosity to form large particles. The polymer solution, on the other hand, has high viscosity and the polymer acts as a protective colloid for the particles of elemental selenium formed and thereby the formation of large aggregation of particles can be prevented.

Reactions, which occur in the binder layer before the end of drying, depend remarkably on the reducing agent used.

The precipitation of elemental selenium may occur to a large extent in the coating composition using the hydrazides but it proceeds mainly during drying after coating the composition on a conductive support using other reducing agents. At the end of drying, a layer of amorphous or red (monoclinic system) selenium fine particles, or a mixture of amorphous, red, and trigonal selenium fine particles dispersed in the electrically insulating polymer is obtained in the case when a hydrazide is used as a reducing agent; and a layer of amorphous selenium fine particles dispersed in a polymer is obtained.

The drying operation is performed at a sufficient temperature for sufficient period of time for completing the reduction of the inorganic selenium compound. The drying temperature is usually from about 20° C. to about 100° C., preferably from about 50° C. to about 100° C. The drying period of time differs greatly according to the drying temperature but usually is from about 5 minutes to about 5 hours, preferably from about 10 minutes to about one hour.

On the other hand where the hydrazides having a relatively strong reducing power are used the deposition of selenium is usually completed in solution or dispersion. In this case drying may be adapted to complete the conversion of amorphous selenium to trigonal selenium. Thus the drying conditions will depend on the reducing agents used.

Amorphous selenium and trigonal selenium can be easily distinguished from each other in the following way. That is, amorphous selenium is yellow-orange while trigonal selenium is grey and as to near ultra-violet and visible region absorption spectra, amorphous selenium has the absorption edge at about 600 n.m. while the absorption edge of trigonal selenium is at a position longer than 700 n.m. Furthermore, by an optical microscope, specific needle crystals are observed for trigonal selenium.

It has been discovered that the conversion of selenium particles to trigonal selenium (crystallization from amorphous selenium or phase transition from monoclinic selenium) is accompanied by a large increase in sensitivity. The conversion to trigonal selenium is accomplished or completed by heat-treatment of the CGL formed on the support. The manner of heat-treatment, however, depends on the reducing agent used. When using one of the hydrazide compounds disclosed above as the reducing agent, it has been found that selenium particles can be converted to trigonal selenium by simply heating the dried layer in contact with a uniformly heated hot plate, irradiating the layer with thermal radiation (e.g., infrared rays, etc.), or immersing the layer in a heated inert (i.e., does not dissolve the photoconductive layer or does not react with the layer) liquid medium (e.g., silicone oil, etc.) and the like.

On the other hand, when reducing agents other than the hydrazides are used, the conversion (crystallization) from amorphous selenium to trigonal selenium does not occur by heating the CGL alone. The photoconductive layer containing amorphous selenium particles dispersed in a binder polymer must be heated as a laminate with the carrier transport layer (CTL) formed on CGL or between a support and CGL. This is believed to be necessary because the conversion proceeds with good efficiency in the air-isolated state. Oxygen in the air is believed to impede the crystallization and by disposing CTL on or under CGL, the supply of oxygen at the interface is insufficient to impede crystallization and the formation of trigonal selenium is promoted. The effect of this treatment shows itself in the ability of CGL to generate charge carriers and inject them into CTL. That is, it is assumed that the formation of a sufficient amount of crystalline selenium particles at the boundary between CTL and CGL is responsible for high light sensitivity. The effect of the hydrazide such that heating in lamination with CTL is unnecessary, is believed to be due to the fact that the hydrazide acts as a reducing agent to promote the crystallization of amorphous selenium or, due to its strong reductive power, the hydrazide is able to react with oxygen and remove it from the vicinity of the amorphous selenium particles. At this time, this is theory and it is not intended to restrict the present invention.

When CTL is heated in contact with CGL (using a reducing agent other than the hydrazides), CTM is unavoidably heated, which results in degradation of the properties by thermal decomposition, oxidation or sublimation of CTM and, thus, there are limitations on the type of CTM which may be used. In this case the dark discharging speed and the residual potential of the photosensitive material is relatively high. This is assumed to be due to thermal decomposition of CTM and the presence of oxidation products.

The heating temperature is usually from about 80° C. to about 250° C., preferably from about 100° C. to about 200° C. and the heating time is usually from about 1 minute to about 1 hour, preferably from about 5 minutes to about 30 minutes. Using the hydrazides, the drying procedure described above could be performed at temperatures from about 80° C. to about 250° C. such that the crystallization of selenium or the phase transition proceeds successively after drying or simultaneously with drying to form a dispersed layer of the fine particles of trigonal selenium. Thus additional heating after drying is sometimes unnecessary, but in general when the drying is performed at about 100° C. to about 200° C. it is difficult to obtain uniform layers. Accordingly the coated layer is preferably first dried at temperatures lower than about 100° C., i.e., to remove the solvent from the layer, and then the layer is heated to temperatures from about 100° C. to about 250° C., as a single layer or in contact with CTL depending on the reducing agent, to convert the selenium particles in the layer to trigonal selenium.

The size of the fine particles of trigonal selenium in the photoconductive layer dispersed in the electrically insulating binder polymer prepared in the above manner in from about 0.5 μm to about 10 μm, preferably from about 1 μm to about 5 μm in the long axis and from about 0.3 μm to about 1 μm in the short axis.

According to the process of this invention a layer containing elemental selenium more uniformly dispersed in a binder polymer is obtained as compared to the process of liberating elemental selenium by photodecomposition of dispersed organic selenium compound as described in U.S. Pat. No. 3,994,791 and also, photoconductive elements can be prepared using inorganic selenium compounds which are more stable, safe, and less expensive than organic selenium compounds. Furthermore, one of the principal advantages of this invention is that not only polymers having charge carrier transporting faculty but also electrically inactive insulating polymers can be used as the binder polymers.

The photoconductive elements of this invention are useful as photoconductive layers of electrophotosensitive materials. In more detail, the elemental selenium dispersed layer obtained by coating the solution or dispersion for photoconductive element prepared by dissolving or dispersing (a) the inorganic selenium compound, (b) the insulating polymer, and, preferably, (c) the reducing agent in a solvent capable of dissolving at least the polymer (b) followed by drying as stated above is used as a layer which generates charge carriers by the irradiation of light (hereinafter, referred to as "carrier generating layer" of "CGL") in electrophotosensitive materials.

The photoconductive material having the layer of the dispersed fine particles of trigonal selenium (i.e., a photoconductive layer) on a conductive support has a high saturated surface potential per unit area of the photoconductive layer (e.g., the layer can be charged up to 100 volts/μm as in the case of a multilayer photoconductive layer having CTL laminated thereon, which will be explained later), has sufficiently high light discharging speed of the surface charges (or surface potential), i.e., sufficiently high light sensitivity of the photoconductive material, and further shows almost the same light sensitivity when the polarity of the surface charges is positive or negative.

The above-mentioned single photoconductive layer of dispersed trigonal selenium (prepared using a hydrazide as a reducing agent) can be used for electrophotosensitive materials as it is, i.e., not in combination with CTL. However, for obtaining images having high contrast by toner development, the surface of the photoconductive layer must be sufficiently charged and for the purpose it is sometimes necessary to increase considerably the thickness of the photoconductive layer (for example, to greater than 5 μm). If the thickness increases, the charge and hence the surface potential on the photoconductive layer increases, but at the same time the light discharging saturation potential, i.e., the residual potential, tends to increase and also the content of selenium per unit area in the photoconductive material increases. Therefore, to maintain the residual potential and selenium content as low as possible, increase the amount of charge without reducing the high light sensitivity, and also increase the mechanical strength (scratch resistance, abrasion resistance, etc.) of the surface, a charge carrier transporting layer (CTL) can be formed on the thin trigonal selenium dispersed layer as CGL (e.g., 0.5–2 μm). CTL can effectively inject and transport the charge carriers generated in the CGL by the irradiation of light and discharge the charges at the surface of a conductive support or the conductive layer. In this case, it is preferred to dispose CTL adjacent to CGL to form a photoconductive laminate (or double layer) structure. In this case, CTL may be disposed above or below CGL formed on a conductive support. On the other hand, when a single photoconductive layer is formed by mixing the components for CGL and the components for CTL, the sensitivity of the photoconductive layer formed is greatly inferior to the photoconductive layer of the above-mentioned laminate structure or double structure.

For forming amorphous or trigonal selenium dispersed layers or CGL consisting of the elemental selenium dispersed layer which is the photoconductive element of this invention, the above-described solution or dispersion for the photoconductive element may be coated on a conductive support or on CTL formed on a conductive support and dried. The coating operation for any layer in the present invention may be carried out by any conventional method using, for example, rod coating, roller coating, curtain coating, dip coating, spin coating, whirler coating, etc. The coating temperature is usually from about 0° C. to about 80° C., preferably from about 20° C. to about 50° C. The coated layer is dried suitably under the conditions described in relation to photoconductive elements. In case of aiming at drying only, the drying temperature is usually from room temperature to about 200° C., preferably 50° to 100° for from about 5 minutes to about 5 hours, more particularly from 10 minutes to 2 hours. The coating amount of the selenium particle dispersed layer or CGL is so adjusted that the dry thickness of CGL is in the range of from about 0.1 μm to about 10 μm, preferably from 0.5 to 5 μm.

Conductive supports used, in general, for electrophotosensitive materials may be used as the supports in this invention and suitable examples of such conductive supports are various metal plates or foils; plastic films vacuum deposited with a metal such as aluminum, nickel, chromium, silver, gold, copper, palladium, etc., or a semiconductor such as indium oxide, tin dioxide, etc.; and plastic films having thereon a layer having dispersed in the binder polymer a conductive substance such as cuprous iodide, carbon black, etc.

In general, any known or conventional CTL may be used in this invention. That is, CTL used in this invention may be, for example, a layer of a photoconductive polymer such as poly-N-vinylcarbazole (U.S. Pat. No. 3,037,861), polyvinylpyrene (British Pat. No. 1,506,929), or the charge transfer complex of trinitrofluorene (Japanese Patent Publication No. 10496/'75 or may be a layer of a low molecular weight charge carrier transporting material (CTM) (such a material is sometimes called an organic photoconductive material or an organic electrically active material) dispersed in an insulating polymer.

As charge carrier transporting materials, many compounds are known and are suitably used in this invention. However, when the layer of dispersed selenium is heated in contact with the CTL, the CTM contained in CTL is unavoidably heated, which results in degradation of the properties by the thermal decomposition, oxidation, or sublimation of CTM, and thus CTM should not be sublimable or decomposable. When hydrazide is used as a reducing agent this is not a problem since CTL need not be heated.

Examples of CTM are triarylmethanes (U.S. Pat. No. 3,542,547), triarylalkanes and tetraarylmethanes (U.S. Pat. No. 3,542,544), diarylalkanes (U.S. Pat. No. 3,615,402), N,N-dibenzylaniline derivatives (U.S. Pat. No. 3,767,393), aniline derivatives (British Pat. No. 1,316,994), distyryl-containing aromatic compounds (U.S. Pat. No. 3,873,311), polyaryl hydrocarbons (U.S. Pat. No. 4,045,220), tritolylamine (U.S. Pat. No. 3,732,554), arylamines (U.S. Pat. Nos. 3,240,597; 3,180,730; 3,567,450; 3,658,520; and 3,615,414), tetraphenyldiaminobiphenyls (U.S. Pat. Nos. 4,047,948 and 4,047,949), 4-diarylamino-substituted calcons (U.S. Pat. No. 3,615,414), pyrazolines (U.S. Pat. Nos. 3,837,851 and 3,180,729), oxadiazoles (U.S. Pat. No. 3,189,447), thiadiazoles (British Pat. No. 1,004,929), 5-aminothiadiazoles (U.S. Pat. No. 3,161,505), triazoles (U.S. Pat. Nos. 3,112,197 and 3,122,435 and British Pat. Nos. 951,106 and 952,906), imiazolones (U.S. Pat. No. 3,097,095), oxazoles (British Pat. No. 874,634), thiazoles (British Pat. No. 1,008,631), imidazoles (British Pat. No. 938,434), bisimidazolidines (U.S. Pat. No. 3,127,266), pyrazines (British Pat. No. 1,004,461), 1,2,4-triazines (U.S. Pat. No. 3,130,046), allylideneoxazolones (U.S. Pat. No. 3,072,479), benzothiazoles, benzimidazoles and benzoxazoles (British Pat. Nos. 895,001 and 1,008,632), quinazolines (U.S. Pat. No. 3,139,339), benzofurans (U.S. Pat. No. 3,140,946), acridines and phenazines (U.S. Pat. No. 3,244,516), carbazoles (U.S. Pat. No. 3,206,306), ethylene derivatives (U.S. Pat. No. 3,246,983), benzylideneanilines (British Pat. No. 836,151), polyenes (British Pat. No. 964,874), aminostilbenes (U.S. Pat. No. 3,158,475), arylketones (British Pat. No. 1,008,633), etc.

Among these CTM, examples particularly useful in the electrophotosensitive materials of this invention are layers of, as low molecular weight photoconductive (charge carrier transporting) materials, pyrazolines such as 1,3,5-triphenylpyrazoline, 1-phenyl-3-(p-dimethylaminostyryl)-5-(p-dimethylaminophenyl)-pyrazoline, 1-phenyl-3-(p-methoxystyryl)-5-(p-methoxyphenyl)-pyrazoline, 1-phenyl-3-styryl-5-phenylpyrazoline, 1-phenyl-3-phenyl-5-(p-dimethylaminophenyl)-pyrazoline, etc.; triarylmethanes and diarylmethanes such as leuco-malachite green, leuco crystal violet, tetrabase, etc.; the triarylmethane compounds such as 4,4'-benzylidene-bis(N,N-diethyl-m-toluidine), 2',2''-dimethyl-4,4',4''-tris(dimethylamino)triphenylmethane, etc.; described in U.S. Pat. No. 3,542,547; the diarylalkanes such as 2,2-bis(4-N,N-dimethylaminophenyl)propane, 1,1-bis(4-N,N-dimethylaminophenyl)cyclohexane, etc., described in U.S. Pat. No. 3,615,402; the tetraarylmethane compounds and triarylalkane compounds such as bis(4-dimethylamino)-1,1,1-triphenylethane, 4-dimethylaminotetraphenylmethane, etc., described in U.S. Pat. No. 3,542,544; calcons and diarylketones such as 4-N,N-dimethylaminophenyl-4'-N,N-dimethylaminostyryl ketone, 1-(p-N,N-dimethylaminobenzoyl)-4-(p-N,N-dimethylaminophenyl)-butadiene-1,3, di(p-N,N-dimethylaminostyryl)ketone, di(p-N,N-diethylaminophenyl)ketone, etc.; aminated hydrocarbons such as p-N,N-dimethylaminostilbene, p-p'-N,N,N',N'-tetramethyldiaminostilbene, etc.; arylamines typified by tritolylamine, triphenylamine, diphenylamine, tetraphenyldiaminobiphenyl, etc.; and trinitrofluorenone as well as high molecular weight photoconductive materials such as poly-N-vinylcarbazole, the charge transfer complex of poly-N-vinylcarbazole and trinitrofluorenone (the mole ratio of carbazole ring and trinitrofluorenone being 5/1 to 1/2), etc.

When a high molecular weight photoconductive material is used for CTL, the material is dissolved in a solvent and coated on a conductive support or CGL formed on a conductive support followed by drying. The proportion of the high molecular weight photoconductive material to solvent is preferably from about 0.5 to about 0.01 g, particularly about 0.2 to 0.003 g per milliliter of solvent. When a low molecular weight charge carrier transporting material is used for CTL, the material is dissolved in a common solvent together with an insulating polymer and coated on a conductive support or CGL formed on a conductive support followed by drying. In this case, the proportion of the charge carrier transporting material (CTM) (or the sum of them when a mixture of these materials is used) to the insulating polymer is preferably from about $10^{-4}$ to about $5\times10^{-3}$ mole, particularly from $3\times10^{-4}$ to $3\times10^{-3}$ mole per gram of the insulating polymer and the proportion of the insulating polymer to the solvent is preferably from about 0.5 to about 0.01 g, particularly from 0.2 to 0.03 g per milliliter of the solvent. The insulating polymers described above in relation to the photoconductive elements of this invention can be used as the CTL insulating polymer. Among these insulating polymers, polycarbonate (e.g., the polycarbonate of bisphenol A), polymethyl methacrylate, polyvinyl butyral, etc., are particularly suitable because when they are used for CTL in this invention, the charge carrier transporting efficiency is high and the mechanical strength is high. The solvent used in this case may be suitably selected from the above-mentioned solvents used for preparing the solutions or dispersions for the photoconductive elements of this invention.

The coating amount is preferably so adjusted that the dry thickness of CTL becomes from about 1 to about 100μ, more preferably about 5 to 30μ and most preferably 5 to 20μ. The coating and drying operations can be performed in the same manner as described above in relation to CGL. There is no particular limitation about the drying temperature of CTL but is preferred to avoid drying at too higher temperatures especially when using a hydrazide where heating is not necessary to crystallize the selenium after coating CTL in order to prevent the thermal decomposition or sublimation of CTM and preferred temperature is from about 20° C. to about 100° C. The drying period of time differs largely accordingly to the drying temperature and the solvent used and is usually from about 5 minutes to about 5 hours, preferably from 10 minutes to one hour.

A charge carrier transporting material used for CTL is, in general, essentially a photoconductive material but the majority of these materials are sensitive to ultraviolet radiation and show no absorption in a visible region or show an absorption in a relatively low wavelength region only of a visible region. Therefore, the disposition of CTL on CGL is not a problem since the active light required for generating charge carriers in CGL, i.e., visible light, substantially passes through CTL. Regardless of whether CGL is disposed on or under CTL on a conductive support, visible light is mainly absorbed by CGL and the charge carriers are mainly generated in CGL. An electrophotosensitive material prepared by forming CTL only on a conductive support without using CGL shows little or no light sensitivity to visible light.

The electrophotosensitive materials prepared in accordance with the process of this invention can be used in ordinary reproduction processes, for example, a process wherein electrophotosensitive materials can be reused after being regenerated such as a toner image transfer process or an electrostatic latent image transfer process and a process wherein permanent toner images are formed in fixed state on the electrophotosensitive materials without performing regeneration thereof for reuse.

That is, the electrophotosensitive material in accordance with this invention is uniformly charged, in the state that the conductive layer of the conductive support is electrically grounded, in the dark by means of a charging means until the surface potential reaches about 200–1,000 volts by means of a charging apparatus such as Corotoron or Scorotron. Then, the photosensitive material thus charged is imagewise exposed from the surface side (when the conductive support is transparent to the active light, the electrophotosensitive material is image exposed from the surface side or from the back side through the support), thereby the surface potential is discharged at the exposed portions to form electrostatic latent images. Thereafter, the latent images are developed by a toner and the toner images formed may be transferred onto an image receiving sheet and fixed or may be fixed as they are on the surface of the photosensitive material to form permanent images there, or further the aforesaid electrostatic latent images may be toner developed and fixed after being transferred onto an image receiving sheet. These image forming processes are described in, for example, John W. Weigl, "Angew. Chem.", (International edition), 16, 374 (1977).

The electrostatic latent image forming mechanism of the photoconductive materials prepared by the process of this invention is illustrated as follows. (The mechanism is described for the case in which CTL is formed on CGL layer). When an image exposure is performed in the state that the surface of CTL has electrostatic charges, an electron and positive hole pair is formed in the inside or on the surface of the fine particles of amorphous or trigonal selenium in CGL and the pair is separated under an electric field to form free charge carriers. One of the charge carriers is transported to the conductive support depending on the potential gradient and discharged, while the other is transported to the interface with CTL, injected into CTL, transported through CTL, and discharged at the surface where it neutralizes the electrostatic charges. The light discharging step differs with the polarity of the electrostatic charges on the surface of CTL and the kind of CTM in CTL. That is, if the surface charge is negative, the electron generated in CGL is discharged to the support, while the positive hole is transported to the surface of CTL and discharged there. If the surface charge is positive, the positive hole is discharged to the support, while the electron is transported to the surface of CTL and discharged there. Therefore, it is preferred that CTM in CTL is of p-type suitable for positive hole transportation in the former case and is of n-type suitable for electron transportation in the latter case since the light discharging speed and hence the light sensitivity is high.

When the construction of the photoconductive layer is contrary to the above-mentioned one, that is, when CTL is disposed adjacent to the conductive support and electrostatic charges are formed on the surface of CGL, the mechanism is reversed. That is, when the electrostatic charges on the surface of CGL are negative, it is desirable that the charge carrier transporting material in CTL be of an n-type, while when the electrostatic charges are positive, it is desirable that the charge carrier transporting material be of a p-type.

In the above-mentioned charge carrier transporting materials, trinitrofluorenone and the charge transfer complex of trinitrofluorenone and poly-N-vinylcarbazole are of n-type and suitable for the transportion of electron and other materials are almost of p-type and are effective for the transfer of positive hole. In particular, the p-type charge carrier transporting materials are mostly excellent in transporting efficiency (mobility) or in the injecting efficiency of charge carriers from CGL to CTL. In the case of forming CTL using the p-type charge carrier transporting material, the most preferred embodiment of the electrophotosensitive materials of this invention is that CTL is disposed adjacent to a conductive support when the surface of the photosensitive material is positively charged and that CGL is disposed adjacent to a conductive support when the surface is positively charged. In these cases almost the same light sensitivity is obtained regardless of the polarity of electrostatic charges. In addition, in the case of forming CTL using the n-type charge carrier transporting material, a high light sensitivity is obtained when the polarity of the electrostatic charges on the surface of the electrophotosensitive material is contrary to the above-mentioned one.

The main merits obtained by this invention are as follows:

First, electrophotosensitive materials having high light sensitivity are obtained using a very small amount of selenium. For example, almost the same sensitivity as the case of the vapor deposition of selenium using selenium in an amount of one several thousandth of that in the vapor deposition case.

Second, the transmission optical density of the photoconductive layer is considerably low and hence when a transparent conductive support is used, electrophotosensitive materials which are nearly transparent are obtained.

Third, electrophotosensitive materials are prepared by coating without the need of vapor deposition and hence they can be produced continuously, mass produced, which results in a reduction in the production costs.

Fourth, when trigonal selenium is used as the photosensitive substance, photoconductive materials having panochromatic spectral sensitivity are obtained.

Fifth, the light discharging characteristics of the electrophotosensitive materials obtained by the process of this invention are very excellent in the following points. That is, if the kind of CTL and the thickness of CGL are suitably selected, the fatigue of the electrophotosensitive materials by light discharging is much less and hence the photosensitive materials can be repeatedly used many times in a short period of time. Furthermore, since the residual potential is small and the electrostatic charges on the surface of the electrophotosensitive material can be almost completely discharged by applying a sufficient amount of light exposure, reproductions having less fog are obtained.

Now, the invention will be explained in more detail by the following examples. The invention is not, however, limited to these examples.

In addition, in the following examples, the photoconductive characteristics of the electrophotosensitive materials were measured using an electrostatic charging test means, Model SP-428 made by Kawaguchi Denki K.K. That is, the conductive support of the electrophotosensitive material was grounded, the surface of the photoconductive layer was charged by corona discharge, and exposed to light from a tungsten lamp (color temperature: 2856° K.) which was focused and weakened by an ND filter, and then the decay of the surface potential by light, i.e., the light discharging speed was measured. From the result, the initial light discharging speed, i.e., $(dV/dt)_0/I.d$ (wherein V is a surface potential (volts), t is time (seconds), I is illuminance (lux), and d is the thickness of photoconductive layer (μm)), $E_{\frac{1}{2}}$, i.e., the exposure energy (lux.sec) required to discharge the charges until the surface potential becomes ½ of the initial potential $V_0$, and $V_R$, i.e., the so-called residual potential (volt) at which the reduction of potential by light exposure becomes almost constant were determined. In addition, the illuminance was 0.1 lux.

EXAMPLE 1

To 5 g of N,N-dimethylformamide were added 45 mg of selenium dioxide and 200 mg of polymethyl methacrylate (mean molecular weight of about 50,000) and the mixture was stirred for 5 hours to completely dissolve the components and to provide a colorless solution. The solution was coated on an aluminum-deposited polyester film ("Metalumy", a trade name, made by Toray Co., Ltd.) using a coating rod and dried for one hour under a hot air stream at 60° C. to form CGL. The dry thickness of CGL was about 15 μm and the color was light yellow.

Then, 35 mg of 1-phenyl-3-(p-methoxystyryl)-3-(p-methoxyphenyl)pyrazoline (charge carrier transporting material) and 55 mg of a polycarbonate resin, "Eupiron C-2000" (a trade name, mean molecular weight about 24,000, made by Mitsubishi Gas Chemical Co., Ltd.) were dissolved in 1 g of chloroform and the solution was coated on the CGL mentioned above using a coating rod and dried for one hour under hot blast of 60° C. to form CTL, whereby a photoconductive layer composed of two layers was formed on the donductive support. The dry thickness of the combined layers was about 10 μm.

When the electrophotosensitive material thus obtained was heat treated by closely contacting the support side with a hot plate of 150° C. for 5 minutes, the color of the photoconductive layer changed to light yellow-grey. The initial light discharging speed was 0.3 ($V_0=-500$ volts).

In addition, when the same procedure as above was practiced except that CGL was not formed, light discharge was scarcely observed (the initial light discharge speed was lower than 0.05, $V_0=-500$ volts) and when the same procedure as above was also practiced except that selenium dioxide was not added, no light discharge was observed ($V_0=-500$ volts). Thus, it will be understood that the elemental selenium containing photoconductive element of this invention can function as a photoconductive layer of an electrophotosensitive material.

EXAMPLES 2–9

A solution of selenium dioxide and polymethyl methacrylate in N,N-dimethylformamide was prepared as in Example 1 and after adding to the solution $8\times10^{-4}$ mole (2 mole times as large as 45 mg of selenium dioxide) of the reducing agent described in following Table 2 and mixing them uniformly by stirring, the solution was coated immediately on an aluminum-vapor deposited polyester film (as in Example 1) and dried for one hour under a hot stream of 60° C. to form CGL. The color of the coating solution differed according to the kind of the reducing agent used and was red to light yellow. The color of CGL after drying was red to yellow. The dry thickness of CGL was about 1.5 μm.

Thereafter, CTL was formed thereon as in Example 1 and heat treatment was applied thereto. The color of the photoconductive layer after the heat treatment was grey to dark red. The photoconductive characteristics of the electrophotosensitive materials are shown in Table 2.

TABLE 2

| Example | Reducing agent | $V_0$ (volt) | (A) | $E_{\frac{1}{2}}$ | $V_R$ |
|---|---|---|---|---|---|
| 2 | L-ascrobyl monopalmitate | +500 | 3 | — | — |
| | | −500 | 15 | 1.2 | 30 |
| 3 | Salicyloylhydrazide | −500 | 20 | 1.2 | 20 |
| 4 | 1-Phenyl-3-pyrazolidone | " | 13 | 1.5 | 40 |
| 5 | Thiourea | " | 15 | 1.4 | 40 |
| 6 | Trimethylhydroquinone | " | 19 | 1.2 | 20 |
| 7 | Tetramethylhydroquinone | " | 18 | 1.2 | 30 |
| 8 | Methoxyhydroquinone | " | 14 | 1.2 | 40 |
| 9 | 2,5-Di-tert-butyl-hydroquinone | " | 16 | 1.2 | 30 |

(A): Initial light discharge speed.

In addition, when the discharge and exposure were continuously repeated 10 times, the same initial light discharging speed and the same $E_{\frac{1}{2}}$ value are obtained. That is, electrical fatigue is not observed.

Also, the electrophotosensitive material prepared in Example 6 was charged at a surface potential of −500 volts using Corototron, exposed for 3 seconds through a positive transparency using a tungsten lamp (the illuminance at the surface of the transparent was about 5 lux), and then immediately subjected to cascade development using a positively charged toner, thereby a sharp positive image was obtained.

EXAMPLE 10

The same procedure as in Example 6 was followed except that 52 mg of selenious acid was used in place of 45 mg of selenium dioxide. The initial light discharge speed was 3, $E_{\frac{1}{2}}$ was 9, and $V_R$ was 100 ($V_0=-500$ volts).

EXAMPLES 11–17

The same procedure as in Example 6 as followed except that 200 mg of each polymer shown in the following Table 3 was used as the binder polymer for CGL in place of 200 mg of polymethyl methacrylate and 37 mg of 4,4'-benzylidenebis(N,N-diethyl-m-toluidine was used as the charge carrier transporting material in place of 35 mg of 1-phenyl-3-(p-methoxystyryl)-5-(p-methoxyphenyl)pyrazoline. The results obtained are shown in Table 3 ($V_0=-500$ volts).

TABLE 3

| Example | Polymer | (A) | $E_{\frac{1}{2}}$ | $V_R$ |
|---|---|---|---|---|
| 11 | Polycarbonate, "Eupiron", made by Mitsubishi Gas Chemical Co | 17 | 1.3 | 50 |
| 12 | Polyvinylformal (made by Denki Kagaku Kogyo K.K.) | 14 | 1.3 | 20 |
| 13 | Polyvinylbutyral (made by Denki Kagaku Kogyo K.K.) | 5 | — | 150 |
| 14 | Polyvinyl chloride (made by Nippon Zeon Co.) | 12 | 1.6 | 100 |
| 15 | Poly(vinylidene chloride-acrylonitrile), "Saran F-220" copolymerization ratio 4:1, made by Asahi Dow Limited) | 3 | 10 | 120 |
| 16 | Cellulose acetate butyrate, "EAB", made by Eastman Kodak Co. | 13 | — | 150 |
| 17 | Diacetyl cellulose (Daicel Ltd.) | 3 | — | 200 |

(A): Initial light discharge speed.

EXAMPLES 18–26

The same procedure as in Example 6 was followed except that each of the compounds shown in following Table 4 was used in an amount of $1.6\times10^{-3}$ mole per gram of the polycarbonate resin as the charge carrier transporting material in place of 1-phenyl-3-(p-methoxystyryl)-5-(p-methoxyphenyl)pyrazoline. The results obtained are shown in Table 4.

TABLE 4

| Example | Charge Carrier Transporting Material | $V_0$ (volt) | (A) | $V_R$ | (B) |
|---|---|---|---|---|---|
| 18 | 1-Phenyl-3-styryl-5-phenyl-pyrazoline | −500 | 19 | 20 | none |
| 19 | 1,3,5-Triphenylpyrazoline | " | 10 | 200 | less |
| 20 | Leuco-malachite green (bis(4,4'-N,N—dimethylamino-phenyl)phenylmethane) | " | 9 | 300 | severe |
| 21 | 4,4'-Benzylidenebis(N,N—diethyl-m-toluidine) | " | 15 | 100 | none |
| 22 | 1,1-bis(4-N,N—Dimethyl-phenyl)cyclohexane | " | 13 | 200 | none |
| 23 | 2,2-bis(4-N,N—Dimethylamino-phenyl)propane | " | 5 | 200 | less |
| 24 | 4-N,N—Dimethylaminophenyl-4'-N,N—dimethylaminostyryl-ketone | " | 4 | 150 | severe |
| 25 | p-N,N—Dimethylaminostilbene | " | 3 | 200 | none |
| 26 | 2,4,7-Trinitrofluorenone | +500 | 4 | 350 | severe |

(A): Initial light discharge speed
(B): Fatigue.

EXAMPLES 27–28

The same procedure as in Example 6 was followed except that the following solution was used as the coating solution for CTL in each example. The results obtained are shown in following Table 5.

That is, a solution of 80 mg of poly-N-vinylcarbazole in 1 ml of methylene chloride was used in Example 27 and a solution of 35 mg of poly-N-vinylcarbazole and 56 mg of 2,4,7-trinitrofluorenone in 1 ml of methylene chloride was used in Example 28 as the coating solution for CTL.

TABLE 5

| Example | (C) | $V_0$ | (A) | $E_{\frac{1}{2}}$ | $V_R$ | (B) |
|---|---|---|---|---|---|---|
| 27 | 6 μm | −400* | 2 | 11 | 100 | severe |
| 28 | 8 μm | −400* | 4 | 6 | 0 | none |
| | | +300* | 3 | 7 | 0 | none |

(A): Initial light discharge speed
(B): Fatigue
(C): Thickness of photoconductive layer
(*): Saturated potential

EXAMPLES 29–30

The same procedure as in Example 6 was followed except that the film (almost transparent) shown in Table 6 was used in place of the aluminum-vapor deposited polyester film as the conductive support. The results obtained are shown in Table 6. ($V_0$=−500 volts).

TABLE 6

| Example | Conductive support | (A) | $E_{\frac{1}{2}}$ | $V_R$ |
|---|---|---|---|---|
| 29 | Palladium-vapor deposited polyester film | 15 | 1.4 | 30 |
| 30 | Indium oxide-vapor deposited polyester film | 14 | 1.4 | 30 |

(A): Initial light discharge speed

EXAMPLES 31–34

The same procedure as in Example 6 was followed except that the amount of selenium dioxide used in each example was charged as shown in following Table 7 (the amount of selenium dioxide in Example 33 was same as that in Example 6). The results obtained are shown in Table 7. ($V_0$=−500 volts).

TABLE 7

| Example | $SeO_2$ (mg) | (D) (mol/g) | (A) | $E_{\frac{1}{2}}$ | $V_R$ |
|---|---|---|---|---|---|
| 31 | 11 | $0.5 \times 10^{-3}$ | 7 | 3 | 30 |
| 32 | 22 | $1.0 \times 10^{-3}$ | 14 | 1.4 | 20 |
| 33 | 45 | $2.0 \times 10^{-3}$ | 19 | 1.2 | 20 |
| 34 | 90 | $4.0 \times 10^{-3}$ | 17 | 1.3 | 30 |

(A): Initial light discharge speed
(D): Weight ratio of selenium dioxide to binder polymer.

EXAMPLES 35–38

The same procedure as in Example 6 was followed except that the amount of trimethylhydroquinone used was changed as shown in following Table 8 (however, the amount in Example 37 was same as the amount in Example 6). The results obtained are shown in Table 8 ($V_0$=−500 volts).

TABLE 8

| Example | Trimethylhydroquinone (mg) | (E) | (A) | $E_{\frac{1}{2}}$ | $V_R$ |
|---|---|---|---|---|---|
| 35 | 63 | 1/1 | 3 | 7 | 30 |
| 36 | 94 | 1.5/1 | 10 | 2.5 | 30 |
| 37 | 125 | 2/1 | 19 | 1.2 | 20 |
| 38 | 250 | 4/1 | 16 | 1.5 | 20 |

(A): Initial light discharge speed
(E): Mole ratio of trimethylhydroquinone to selenium dioxide.

EXAMPLES 39–42

The same procedure as in Example 6 was followed except that the thickness of CGL coated was changed as shown in following Table 9 (the thickness in Example 40 was same as that in Example 6). The results obtained are shown in Table 9 ($V_0$=−500 volts).

TABLE 9

| Example | Dry thickness of CGL (μm) | Initial Light Discharge Speed | $E_{\frac{1}{2}}$ | $V_R$ |
|---|---|---|---|---|
| 39 | 0.8 | 9 | 2.5 | 0 |
| 40 | 1.5 | 19 | 1.2 | 20 |
| 41 | 2.5 | 15 | 1.3 | 80 |
| 42 | 4.0 | 12 | 2.0 | 150 |

EXAMPLE 43

The same procedure as in Example 6 was followed except that the coating order of CGL and CTL was reversed. When the initial potention ($V_0$) was adjusted to +500 volts, the initial light discharge speed of 15, $E_{\frac{1}{2}}$ was 1.4, and $V_R$ was 50.

EXAMPLE 44

After dissolving 45 mg of selenium dioxide, 0.4 g of a polycarbonate resin (having the same composition as the resin used for CTL in Example 1), and 280 mg of 4,4'-benzylidenebis(N,N-diethyl-m-toluidine) in 5 g of N,N-dimethylformamide and then dissolving therein 145 mg of trimethylhydroquinone, the solution obtained was immediately coated on an aluminum-vapor deposited polyester film (same as in Example 1) using a coating rod and dried for one hour under hot blast of 60° C. to form a photoconductive layer. The color of the photoconductive layer was deep red and the thickness was 8 μm. The photoconductive layer was heat-treated as in Example 1. The initial light discharge speed was 0.7 ($V_0$=−350 volts (saturated potential)).

EXAMPLE 45

The same procedure as in Example 6 was followed except that the electrophotosensitive material having the laminate of CGL and CTL was not subjected to heat treatment. The color of the photoconductive layer was yellow-orange. The initial light discharge speed was 0.8, $E_{\frac{1}{2}}$ was 15, and $R_R$ was 50 ($V_0$=−500 volts).

EXAMPLE 46

The same procedure as in Example 6 was followed except that in place of laminating CGL and CTL and heat-treating the laminate layer, CGL was formed, dried, heat-treated by closely contacting the support thereof with a hot plate of 150° C. for 5 minutes, and then CTL was coated thereon and dried as in Example 6. The color (yellow-orange) of CGL scarcely changed by the heat treatment of CGL. The initial light discharge speed was 3, $E_{\frac{1}{2}}$ was 7, and $V_R$ as 50 ($V_0=-500$ volts).

EXAMPLE 47

After dissolving 200 mg of polymethyl methacrylate (mean molecular weight: about 50,000) in 5 g of acetone, 45 mg of selenium dioxide was further dissolved in the solution to form an orange solution. The solution was, without the addition of reducing agent, coated on an aluminum-vapor deposited polyester film (same as in Example 1) using a coating rod and dried for one hour under hot blast of 60° C. to form CGL. The color of CGL was orange and thickness thereof was about 1.3 μm.

Then, 35 mg of 1-phenyl-3-(p-methoxystyryl)-5-(p-methoxyphenyl)pyrazoline (charge carrier transporting material) and 45 mg of a polycarbonate resin (same as in Example 1) were dissolved in 1 g of chloroform and the solution thus obtained was coated on above-mentioned CGL using a coating rod and dried for one hour under hot blast of 60° C. to form CTL, thereby a photoconductive layer composed of CGL and CTL was formed on the conductive support. The dry thickness of the whole layers was about 10 μm. The initial light discharge speed of the electrophotosensitive material thus obtained was 0.4 ($V_0=-500$ volts).

EXAMPLE 48

The electrophotosensitive material obtained in Example 47 was heat-treated by closely contacting the support thereof with a hot plate of 150° C. for 5 minutes. The color of the photoconductive layer after heat treatment was yellow-grey. The initial light discharge speed was 7, $E_{\frac{1}{2}}$ was 3, and $V_R$ was 30 ($V_0=-500$ volts).

EXAMPLES 49 AND 50

In 10 ml of ethanol were dissolved 0.6 g of polyvinylbutyral (insulating binder polymer) and 0.13 g of selenium dioxide with stirring for one hour and then 0.37 g of hydrazide salicylate (of 2 mole times the amount of selenium dioxide) was dissolved in the solution, thereby the color of the solution changed from colorless to red-orange and then gradually changed to red. After further stirring the solution for 2 minutes, the solution was coated on an aluminum-vapor deposited polyester film (conductive support) using a coating rod and dried for one hour under a hot stream of 60° C. During drying, coloring of the coated layer increased and after drying the color became red-orange, which was mainly based on that amorphous or monoclinic selenium particles were dispersed in the polymer. In addition, 2 kinds of coating rods were used and the coated layers of two different thicknesses were formed. The dry thicknesses are shown in Table 10. When the photoconductive characteristics were measured in this state, weak light discharging only was observed.

Then, when the support side of the photoconductive material formed was closely contacted with a hot plate heated to 160° C. and heated for 10 minutes, the color of the coated layer became grey. By an optical microscopic observation, it was confirmed that the layer had dispersed therein needle crystals (trigonal selenium) of from about 1 μm to about 5 μm in length, with middle length value of about 3 μm. Also, the existence of trigonal selenium was determined by X-ray diffraction method as well as visible or near ultra-violet absorption spectra. Thus, the photoconductive characteristics of the photoconductive materials having a dispersed layer (photoconductive layer or CGL) of the fine particles of trigonal selenium were measured. The results are shown in Table 10.

TABLE 10

| Example | Thickness of photoconductive layer | $V_0$ | $E_0/I$* | $E_{\frac{1}{2}}$** | $V_R$ | (A) |
|---|---|---|---|---|---|---|
| 49 | about 1.0 μm | −80 | ab.20 | 2.7 | −24 | 0.8 |
| | to 1.5 μm | +70 | ab.16 | 7 | +30 | |
| 50 | 9 μm | −170 | 7 | 1.7 | −30 | 1.5 |
| | | +60 | 3 | 2.4 | +12 | |

(*): Luminance = 0.05 lux,
(**): Luminance = 0.7 lux,
(A): Transmission optical density of photoconductive layer.

EXAMPLE 51

CGL was formed by the same way as in Example 49. A solution of 0.37 g of 1-phenyl-3-p-(dimethylamino)styryl-5-[p-(dimethylamino)phenyl]pyrazoline (CTM) and 0.55 g of polycarbonate of 2,2-bis(p-hydroxyphenyl)propane (insulating binder polymer having mean molecular weight of about 24,000) in 10 g of chloroform was coated on CGL using a coating rod and dried for one hour under hot blast of 60° C. to form CTL, thereby a photoconductive material having a photoconductive laminate was formed. The total thickness of CGL and CTL was about 10 μm. The photoconductive characteristics of the photoconductive material were measured and the results are shown in Table 11. In addition, the dark discharge characteristics were good and the dark decay speed at a surface potential of about +500 volts was sufficiently low.

TABLE 11

| Polarity of charge | $V_0$ | $E_0/I$ | $E_{\frac{1}{2}}$ | $V_R$ |
|---|---|---|---|---|
| − | −400 | 13 | 2.2 | 0 |
| + | +400 | — | — | +350 |

In addition, when the polarity of the charge is positive, $V_R$ is large since CTM is of p-type and electron is not transported.

Another sample than that used in the above measurement was charged −400 volts in the dark, exposed through a positive transparency for 3 seconds at an illumination of 5 lux, and immediately subjected to a cascade development using a toner positively charged, thereby a clear positive image was obtained.

EXAMPLE 52

The same procedure as in Example 51 was followed except that 0.37 g of 4,4'-benzylidenebis(N,N-diethyl-m-toluidine) was used in place of 0.37 g of 1-phenyl-3-p-(dimethylamino)styryl-5-[p-(dimethylamino)phenyl]-pyrazoline as CTM. (CGL was same as in Example 49). The total thickness of CGL and CTL was about 10 μm. In the photoconductive characteristics, $E_0/I=12$, $E_{\frac{1}{2}}=3.7$ and $V_R=-10$ at $V_0=-460$.

EXAMPLE 53

The same procedure as in Example 51 was followed except that 0.26 g of tri(p-tolyl)amine was used in place of 0.37 g of 1-phenyl-3-p-(dimethylamino)styryl-5-[p-(dimethylamino)phenyl]pyrazoline as CTM. (In this case CGL was same as in Example 49 and the total thickness of CGL and CTL was about 8 μm). At $V_0=-250$, $E_0/I=8$, $E_{\frac{1}{2}}=3.4$, and $V_R=-40$.

EXAMPLES 54–56

The same procedure as in Example 51 was followed except that CTM shown in Table 12 was used in place of 0.37 g of 1-phenyl-3-p-(dimethylamino)styryl-5-[p-(dimethylamino)phenyl]pyrazoline as CTM and in Example 56 only 10 g of methylene chloride was used in place of 10 g of chloroform as the coating solvent for CTL, and the results shown in Table 12 were obtained. The thickness of CGL was about 1.5 μm and the total thickness of CGL and CTL was about 10 μm.

TABLE 12

| Example | CTM | $V_0$ | $E_0/I$ | $E_{\frac{1}{2}}$ | $V_R$ |
|---|---|---|---|---|---|
| 54 | 1-Phenyl-3-p-methoxy styryl-5-(p-methoxy-phenyl)pyrazoline 0.37 g | −450 | 11 | 3.1 | −10 |
| 55 | N,N'—Diphenyl-N,N'—di-(m-tolyl)benzidine 0.47 g | −510 | 6 | 8 | −80 |
| 56 | 2,4,7-Trinitro-fluorenone 0.29 g | −430<br>+430 | —<br>6 | —<br>— | −400<br>+220 |

In Example 56, $V_R$ is larger when the polarity of the surface charge is positive since 2,4,7-trinitrofluorenone which is CTM is of n-type and it transports electron more effectively than positive hole.

EXAMPLE 57

CGL was formed by the same way as in Example 49. A solution of 0.8 g of poly-N-vinylcarbazole (CTM) in 10 g of chloroform was coated on the CGL using a coating rod and dried for one hour under hot blast of 60° C. to form CTL, thereby a photoconductive material having a double layer photoconductive layer was formed. The total thickness of CGL and CTL was about 8 μm. When the photoconductive characteristics were measured, $E_0/I=6$ and $V_R=-100$ at $V_0=-460$.

EXAMPLES 58–61

By following the same procedure as in Example 49 except that the insulating binder polymers for CGL, hydrazides, and solvents shown in Table 13 were used, CGL containing dispersed fine particles of trigonal selenium was formed on a conductive support. The thickness of CGL was about 1.5 μm. Then, a solution of 0.37 g of 4,4'-benzylidenebis(N,N-diethyl-m-toluidine) and 0.55 g of the polycarbonate resin (as in Example 51) in 10 g of chloroform was coated on the CGL and dried as in Example 3 to form CTL. The total thickness of CGL and CTL was about 10 μm. The photoconductive characteristics are shown in Table 13.

TABLE 13

| Example | Hydrazide | Electrically Insulating Binder Polymer | Solvent | $V_0$ | $E_0/I$ | $E_{\frac{1}{2}}$ | $V_R$ |
|---|---|---|---|---|---|---|---|
| 58 | hydrazide acetate 0.18 g | polyvinylbutyral (same as in Example 1) 0.6 g | ethanol 10 ml | −500 | 11 | 3.8 | −10 |
| 59 | hydrazide salicylate 0.37 g | diacetyl cellulose 0.6 g | N,N—di-methyl-formamide 10 ml | −480 | 4 | 17 | −50 |
| 60 | hydrazide salicylate 0.37 g | acrylonitrile-butadiene-styrene copolymer 0.6 g | N,N—di-methyl-formamide 10 ml | −480 | 5 | 15 | −50 |
| 61 | hydrazide salicylate 0.37 g | cumaroindene resin 0.6 g | N,N—di-methyl-formamide 10 ml | −450 | 8 | 5 | −15 |

While the invention has been described in detail and with reference to specific embodiments thereof, it will be apparent to one skilled in the art that various changes and modifications can be made therein without departing from the spirit and scope thereof.

What is claimed is:

1. In a process for preparing a photoconductive element comprising elemental selenium dispersed in a binder, the improvement which comprises chemically reducing an inorganic selenium compound in the presence of an insulating polymer.

2. The process of claim 1 which comprises dissolving or dispersing (a) said selenium compound and (b) said polymer in a solvent capable of dissolving at least said polymer, coating said solution or dispersion on a conductive support and drying.

3. The process of claim 1 which comprises dissolving or dispersing (a) said selenium compound and (b) said polymer, and (c) a reducing agent in a solvent capable of dissolving at least said polymer, coating said solution or dispersion on a conductive support and drying.

4. The process of claim 3, wherein said reducing agent is capable of reducing said selenium compound within about 30 minutes when used in a solvent in an amount twice the molar amount of the selenium compound at 100±5° C.

5. The process of claim 3, wherein said reducing agent is represented by the formula (I):

$$R—CO—NH—NH_2 \quad (I)$$

wherein R represents a straight chain or branched chain alkyl group having 1 to 8 carbon atoms, or a phenyl group which may be substituted.

6. The process of claims 2, 3 or 5, wherein said solution dispersion is dried at a temperature and for a time sufficient to complete the reduction of said selenium compound.

7. The process of claim 6, wherein said drying is at a temperature of about 20° to 100° C.

8. The process of claims 2, 3 or 5, wherein after said solution or dispersion is dried, the coating is heat treated to convert said elemental selenium to trigonal selenium.

9. The process of claim 8, wherein said heat treatment is conducted at temperature of about 80° to 250° C.

10. The process of claims 2 or 3, wherein said heat treatment is conducted with said coating sandwiched between said conductive support and another layer.

11. The process of claim 10, wherein said other layer is a charge carrier transporting layer.

12. The process of claims 1, 2, 3 or 5, wherein said selenium compound is any inorganic compound capable of liberating elemental selenium upon reduction.

13. The process of claim 12, wherein said selenium compound is selected from the group consisting of selenium dioxide, selenious acid, selenium (IV) oxybromide, selenium tetrachloride, and selenium tetrabromide.

14. The process of claims 1, 2, 3 or 5, wherein said insulating polymer has charge carrier transporting ability.

15. The process of claims 1, 2, 3 or 5, wherein said polymer is selected from the group consisting of polyvinyl chloride, vinyl chloride-vinyl acetate copolymer, vinylidene chloride-vinyl chloride copolymer, vinylidene chloride-acrylonitrile copolymer, polystyrene, poly-α-methylstyrene, polymethyl methacrylate, polymethyl acrylate, polybutyl acrylate, polyvinylbutyral, polyvinylformal, polyvinylpyrrolidone, polyvinyl alcohol, polyacrylamide, polyacrylonitrile, diacetyl cellulose, triacetyl cellulose, cellulose acetate phthalate, cellulose acetate butyrate, ethyl cellulose, cyanoethyl cellulose, poly-N-vinylcarbazole, polyvinylpyrene, polyester, polyamide, styrene-butadiene copolymer, styrene-methyl methacrylate copolymer, vinylidene chloride-vinyl acetate copolymer, and phenol-formaldehyde resin.

16. The process of claim 5, wherein said polymer is selected from the group consisting of polyvinyl butyral, diacetyl cellulose, triacetyl cellulose, acrylonitrile-styrene-butadiene, cumaroneindene resin and polymethylmethacrylate.

17. The process of claim 1, wherein said selenium compound is present in an amount of $10^{-4}$ to $10^{-2}$ mol per gram of said polymer.

18. The process of claim 5, wherein R is a straight chain alkyl group having 1 to 5 carbon atoms or a hydroxy or methyl substituted phenyl group.

19. The process of claim 5, wherein said hydrazide is selected from the group consisting of hydrazide acetate, hydrazide propionate, hydrazide salicylate, hydrazide p-hydroxybenzoate, hydrazide, 2,4-dihydroxybenzoate, hydrazide 4-methylsalicylate, and hydrazide o-methylbenzoate.

20. In a process for preparing an electrophotosensitive material comprising a conductive support, a charge carrier generating layer (CGL) and a charge carrier transporting layer (CTL) wherein said CGL contains elemental selenium dispersed in a binder, the improvement which comprises forming said elemental selenium by chemically reducing an inorganic selenium compound in the presence of an insulating polymer.

21. The process of claim 20 which comprises dissolving or dispersing (a) said selenium compound and (b) said polymer in a solvent capable of dissolving at least said polymer, coating said solution or dispersion upon a conductive support and drying.

22. The process of claim 20 which comprises dissolving or dispersing (a) said selenium compound, (b) said polymer and (c) a reducing agent in a solvent capable of dissolving at least said polymer, coating said solution or dispersion on a conductive support, and drying.

23. The process of claim 22, wherein said reducing agent is capable of reducing said selenium compound within about 30 minutes when used in a solvent in an amount twice the molar amount of the selenium compound at a temperature of about 100±5° C.

24. The process of claim 22, wherein said reducing agent is represented by the formula (I):

$$R—CO—NH—NH_2 \quad (I)$$

wherein R represents a straight chain or branched alkyl group having 1 to 8 carbon atoms, a phenyl group, or a substituted phenyl group.

25. The process of claims 21, 22 or 24, wherein said solution or dispersion is dried at a temperature and for a time sufficient to complete the reduction of said selenium compound.

26. The process of claim 25, wherein said drying is at about 20° to 100° C.

27. The process of claims 21, 22 or 24, wherein after said solution or dispersion is dried, the coating is heat treated to convert said elemental selenium to trigonal selenium.

28. The process of claim 27, wherein said heat treatment is conducted at a temperature of about 80° to 250° C.

29. The process of claims 21 or 22, wherein said heat treatment is conducted with said CGL sandwiched between said conductive support and said CTL.

30. The process of claims 20, 21, 22 or 24, wherein said selenium compound is any inorganic compound capable of liberating elemental selenium upon reduction.

31. The process of claim 30, wherein said selenium compound is selected from the group consisting of selenium dioxide, selenium oxybromide, selenium tetrachloride and selenium tetrabromide.

32. The process of claims 20, 21, 22 or 24, wherein said insulating polymer has charge carrier transporting ability.

33. The process of claims 20, 21, 22 or 24, wherein said polymer is selected from the group consisting of polyvinyl chloride, vinyl chloride-vinyl acetate copolymer, vinylidene chloride-vinyl chloride copolymer, vinylidene chloride-acrylonitrile copolymer, polystyrene, poly-α-methylstyrene, polymethyl methacrylate, polymethyl acrylate, polybutyl acrylate, polyvinylbutyral, polyvinylformal, polyvinylpyrrolidone, polyvinyl alcohol, polyacrylamide, polyacrylonitrile, diacetyl cellulose, triacetyl cellulose, cellulose acetate phthalate, cellulose acetate butyrate, ethyl cellulose, cyanoethyl cellulose, poly-N-vinylcarbazole, polyvinylpyrene, polyester, polyamide, styrene-butadiene copolymer, styrene-methyl methacrylate copolymer, vinylidene chloride-vinyl acetate copolymer, and phenol-formaldehyde resin.

34. The process of claim 24, wherein said polymer is selected from the group consisting of polyvinyl butyral, diacetyl cellulose, triacetyl cellulose, acrylonitrile-styrene-butadiene, cumaroneindene resin and polymethyl methacrylate.

35. The process of claim 20, wherein said inorganic selenium compound is present in an amount of about $10^{-4}$ to $10^{-2}$ mol per gram polymer.

36. The process of claim 24, wherein R represents a straight chain or branched chain alkyl group having 1 to 5 carbon atoms or a hydroxy or methyl substituted phenyl group.

37. The process of claim 24, wherein said hydrazide is selected from the group consisting of hydrazide acetate, hydrazide propionate, hydrazide salicylate, hydrazide p-hydroxybenzoate, hydrazide 2,4-dihydroxybenzoate, hydrazide 4-methylsalicylate, and hydrazide o-methylbenzoate.

38. A photoconductive element comprising a conductive support and a layer containing elemental selenium dispersed in a binder wherein said elemental selenium is produced by chemically reducing an inorganic selenium compound in the presence of an insulating polymer.

39. An electrophotosensitive material comprising a conductive support, a charge carrier generating layer (CGL) and a charge carrier transporting layer (CTL), wherein said CGL contains elemental selenium dispersed in a binder and said elemental selenium is produced by chemically reducing an inorganic selenium compound in the presence of an insulating polymer.

40. The electrophotosensitive element of claim 39, wherein said element is constructed in the order of said conductive support, said CGL and said CTL.

41. The electrophotosensitive element of claim 39, wherein said element is constructed in order of said conductive support, said CTL and said CGL.

42. The electrophotosensitive material of claims 39, 40 or 41, wherein said CTL is a layer containing a charge carrier transporting material (CTM) uniformly dispersed in an electrically insulating binder polymer.

43. The electrophotosensitive material of claim 42, wherein said CTM is selected from a 1,5-diphenyl-3-styrylpyrazoline derivative, an amino group substituted triphenylmethane derivative, a triarylamine, a benzydine derivative, and trinitrofluorenone.

44. The electrophotosensitive material of claims 39, 40 or 41, wherein said CTL is a layer composed of poly-N-vinylcarbazole or a charge carrier transfer complex of poly-N-vinylcarbazole and trinitrofluorenone.

45. The electrophotosensitive element of claim 42, wherein the electrically insulating binder polymer used for forming CTL is selected from the group consisting of polycarbonate of bisphenol A, polymethyl methacrylate, and polyvinylbutyral.

46. The electrophotosensitive element of claim 39, wherein the thickness of CGL is from about 0.5 μm to about 2 μm.

47. The electrophotosensitive element of claim 39, wherein the thickness of CTL is from about 5 μm to about 20 μm.

48. The process of claims 4 or 23, wherein said reducing agent is hydroxy-substituted aromatic hydrocarbon, a hydrazide derivative, an ascorbic acid derivative, a pyrazolone derivative, a pyrazolidone derivative, a urea derivative, an oxalate, an aldehyde, or salt of an oxidizable metal.

* * * * *